United States Patent [19]

Uhlig et al.

[11] 4,197,804

[45] Apr. 15, 1980

[54] ELECTRICAL CONTACT RETENTION BUSHING METHOD OF MAKING

[75] Inventors: Herbert K. Uhlig, Bainbridge; Clifford R. Waldron, Unadilla, both of N.Y.

[73] Assignee: The Bendix Corporation, Southfield, Mich.

[21] Appl. No.: 935,295

[22] Filed: Aug. 21, 1978

[51] Int. Cl.[2] ..... B21D 53/00

[52] U.S. Cl. ..... 113/119; 29/874; 29/882; 339/275 R

[58] Field of Search ..... 113/119; 29/629, 630 A; 339/275 R, 275 T

[56] References Cited

U.S. PATENT DOCUMENTS

| | | | |
|---|---|---|---|
| 2,004,076 | 6/1935 | Knutson | 113/119 |
| 2,468,169 | 4/1949 | Carlson et al. | 113/119 |
| 2,647,248 | 7/1953 | Ritter | 113/119 |
| 3,273,108 | 9/1966 | Radocy | 29/629 UX |
| 3,348,192 | 10/1967 | DeVito | 339/275 T |
| 3,368,188 | 2/1968 | Olsson | 339/275 R |
| 3,538,491 | 11/1970 | Longenecker | 339/275 T |
| 3,601,786 | 8/1971 | Brubaker | 339/275 R |
| 4,136,628 | 1/1979 | McGonigal et al. | 29/630 R X |

*Primary Examiner*—Leon Gilden

*Attorney, Agent, or Firm*—Kenneth A. Seaman; Raymond J. Eifler

[57] ABSTRACT

An electrical contact retention bushing (100) which is stamped and formed from flat stock. The bushing is stamped in a shape that includes a base portion (110) with a plurality of fingers (120) extending from the base portion. Each finger (120) includes at least one (and preferably two) retention tine (130). Once formed, the bushing fits within and seats on a shoulder (312) of a wafer (300) within an electrical connector. The bushing retains an electrical contact (500) by engaging a shoulder (510) of the contact with the tines (130) on the fingers (120). The bushing (100) is preferably stamped from a soft metal which is then heat-treated to harden it and formed into the desired shape to save weight and manufacturing and material costs when compared with a machined bushing.

5 Claims, 12 Drawing Figures

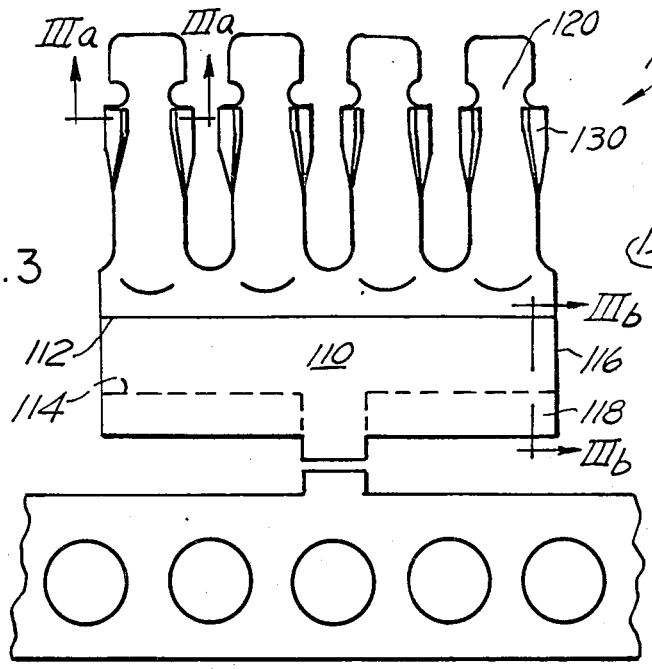
FIG. 3
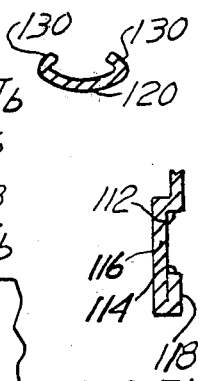
FIG. 3a
FIG. 3b
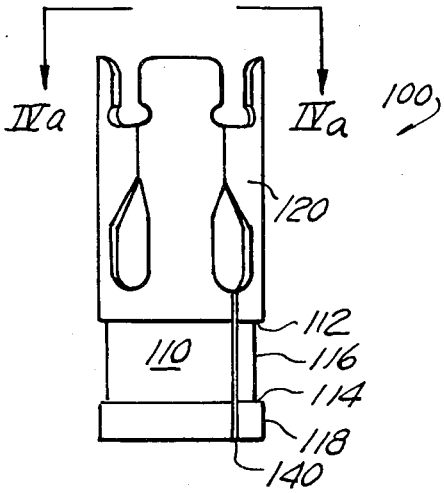
FIG. 4
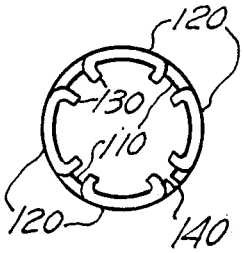
FIG. 4a

FIG.7
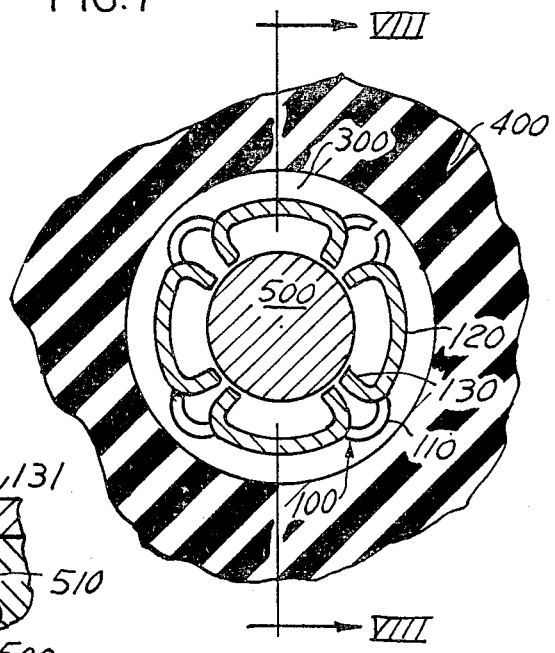
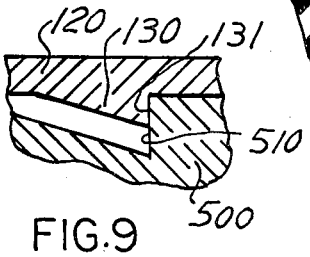
FIG.9
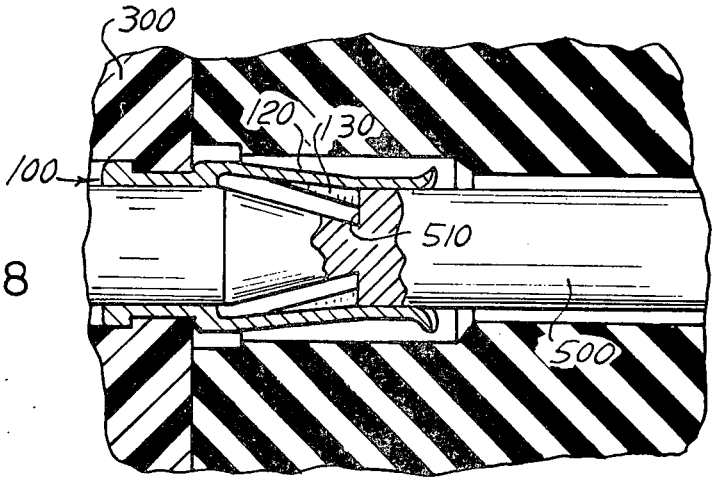
FIG.8

ELECTRICAL CONTACT RETENTION BUSHING METHOD OF MAKING

TECHNICAL FIELD

The present invention relates to electrical connectors and an improved contact retention bushing for releasably retaining an electrical contact within the connector. More particularly, the present invention is a bushing which is stamped from flat stock and formed into the desired shape, rather than being machined from cylindrical stock.

BACKGROUND ART

Electrical connectors typically include anywhere from 1 to over 50 electrical contacts. The connector, in some applications, includes three pieces or layers, a grommet, a wafer, and an insert. Each piece has passages through with contacts extend. A tubular bushing, mounted to the wafer by external shoulders on the bushing, captivates and holds the contact in place by the internal structure of the bushing. One such bushing is machined from cylindrical stock to a final shape which has external and internal shoulders for engaging shoulders on the wafer and the electrical contacts. Such bushings are generally expensive to manufacture because they require an expensive machine which further requires a considerable amount of time to set-up. Further, although the bushing is small, the weight of the machined bushing is greater than desirable when used in aerospace and aircraft applications where every ounce is critical. Another disadvantage is variations in length between contacts unless extremely close tolerances are observed.

To avoid these problems it has been suggested to manufacture contacts by a stamping and forming process. Contacts made by this process generally have the disadvantage that the portion which actually retains the contact is rather weak and does not effectively retain the electrical contact from accidental removal.

The foregoing and other limitations and disadvantages of the prior art electrical contact retention bushings will become apparent to those skilled in the art in view of the following description and the accompanying drawings.

SUMMARY OF THE INVENTION

The present invention is an electrical contact retention bushing which is significantly cheaper to manufacture and requires significantly less expense for the machinery to manufacture the bushing.

The present retention bushing manufacturing method also produces a bushing more uniform in size and thickness as it is not dependent upon machine set-up or variations in machining.

The present invention is a contact retention bushing, and a method of making it, in which the bushing is stamped from flat stock in a shape having a base and a plurality outwardly-extending members or lobes, with each lobe having on each of its sides medially along the length a contact retention tine, which is adapted to engage a shoulder of a contact to retain the contact within the bushing when formed. The steps of the method include (not necessarily in this order): stamping of the bushing as a flat piece; forming of the tines inwardly or transversely of the member; forming the base to include external shoulders for retaining the bushing within a wafer passage; and forming piece entire member into a ring-like structure having a ring-like base and rounded fingers to define a cavity for receiving the contact, with inwardly-extending retention tines for engaging a shoulder of the contact.

The foregoing and other advantages and objects of the present invention will become apparent to one skilled in the art in view of the following description and claims and the accompanying drawings.

BRIEF DESCRIPTION OF THE DRAWINGS

FIG. 3 shows the contact retention bushing of FIGS. 1 and 2 after the inwardly extending tines and rounded lobes, have been formed.

FIG. 3A is a cross-sectional view showing the rounded lobes and tines, taken along the line IIIA—IIIA in FIG. 3.

FIG. 3B shows the shoulders of the base portion looking along the IIIB—IIIB in FIG. 3.

FIG. 4 shows one form of the contact retention bushing which has been formed and may be inserted into a passage to retain a contact.

FIG. 4A is a top view of the contact retention bushing of FIG. 4, looking along the line IVA—IVA in FIG. 4.

FIG. 7 is a cross-sectional view of the bushing and contact of FIG. 6, taken along the line VII—VII in FIG. 6.

FIG. 8 is a partial cross-sectional view of the mounted contact of FIG. 7.

FIG. 9 is an enlarged view of the retention tine and contact portion of FIG. 8.

DETAILED DESCRIPTION OF THE DRAWINGS

Figure 1:
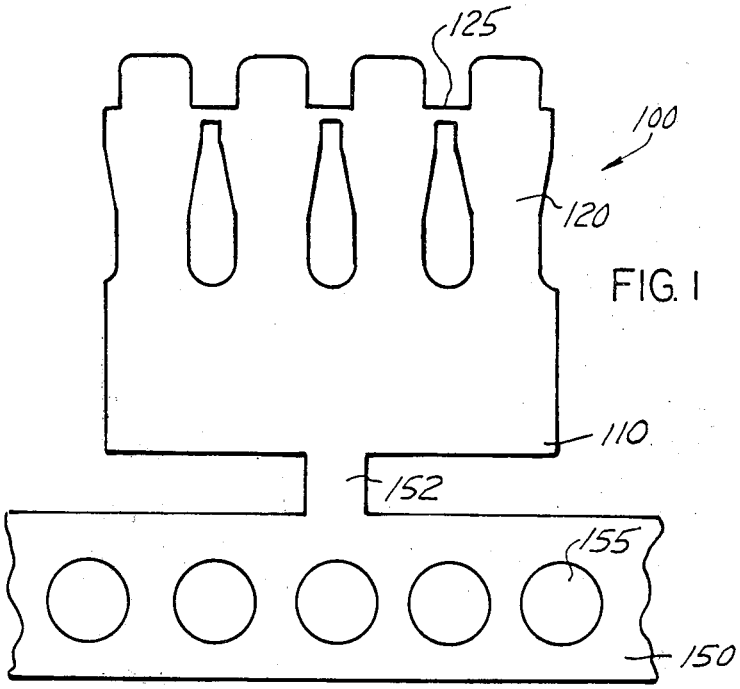
FIG. 1 shows a contact retention bushing which has been partially stamped from flat stock and is attached to a carrier strip.

FIG. 1 is a front view of a contact retention bushing 100 which has been partially stamped from flat stock. The bushing 100 includes a base 110, a plurality of fingers or lobes 120 which extend upwardly from the base 110. A residual piece 125 of material between the adjacent lobes 120 has been left at this stage to connect the adjacent lobes together.

The bushing 100 is stamped as a flat piece from a stock having a uniform thickness. The uniform thickness of the stock insures that the bushing will be of a uniform thickness at this stage of the process and throughout the forming process without being dependent on precise location of metal cutting equipment.

The bushing 100 is connected to a carrier strip 150 by a carrier strip attachment 152. The carrier strip 150 is of a substantial length, to which many bushings 100 are attached. The strip 150 includes pilot holes 155 through which the individual bushings 100 can be advanced from one station to the next in the die automatically and precisely.

In low production quantities, the FIG. 1 bushing shape may be chemically milled. In larger quantities, die stamping of this shape would be faster and more economical, and thus preferred.

Figure 2:
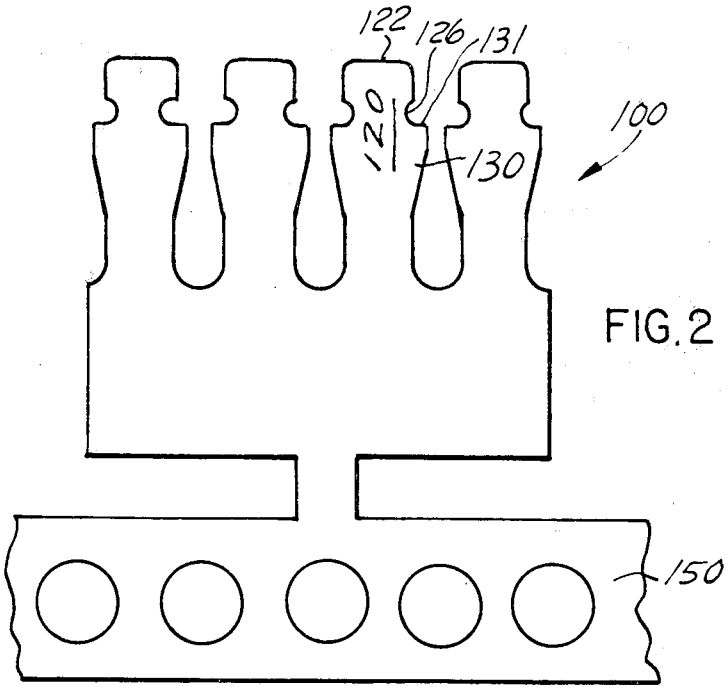
FIG. 2 shows the retention bushing of FIG. 1 after it has been fully stamped to define contact retention portions.

FIG. 2 is a front view of the bushing 100 after an additional stamping operation has been accomplished. Between the FIG. 1 shape and the FIG. 2 shape, the residual piece 125 has been removed and the lobes 120 have been stamped to remove a circular portion of material to form a rounded indentation 126 between a forward lobe portion 122 and a laterally-extending or flaring portion 130. The additional stamping operation performed between FIGS. 1 and 2 also defines the shape of the portions 130 which are now tines.

The rounded indentation 126 serves to minimize the effects of stress, which, if the tines met the lobes at a corner, would be concentrated at the corner. The arcuate shape of the indentation spreads the stress over a larger area.

The tines 130 have an upper edge 131 which will engage a contact shoulder when formed and placed in the electrical connector passage.

FIG. 3 shows a front view of the bushing 100 at a stage in the forming process subsequent to that shown in FIG. 2. The tines 130 have been formed upward and transversely of the fingers or lobes 120, preferably by a die. The lobes 120 have been formed to be arcuate in shape, slightly less than a quarter of the circle each in the embodiment shown. The base portion 110 has been stamped to have a forward shoulder 112 extending across the width of the base portion 110. The rear shoulder 114 is formed by bending a lower portion 118 of the bushing behind and up behind the base 110 to form a double thickness in the lower region. The double thickness creates a second or rear shoulder 114 extending underneath in the FIG. 3 view.

FIG. 3A is a cross-sectional view of one of the retention fingers or lobes 120 and the inwardly extending tines 130 associated with that finger. As shown in FIG. 3A, the finger at this stage is arcuate or rounded in shape and has two retention tines 130 extending approximately perpendicular to the finger 120. When the bushing is completely formed, the tine 130 will extend radially inwardly.

FIG. 3B a partial cross-sectional view of the base portion taken along the IIIb—IIIb in FIG. 3. The forward shoulder 112 and the doubled-over lower portion 118 (i.e., the rear shoulder 114) define a medial portion 116 of the base 110 which extends inwardly, or in the same direction as the tines 130 were bent. When the bushing is completely formed, the tines 130 and the medial portion 116 will be radially inside of the periphery of the bushing.

FIG. 4 is a view of the contact retention bushing 100 in one embodiment after it has been formed. The bushing 100 includes the base portion 110 and the fingers 120. The tines extend inwardly from the fingers 120 and are not shown in this view. A seam 140 is formed by the meeting of the two sides of the base 110. The base 110 includes the forward shoulder 112, the rear shoulder 114 and the medial portion 116 of a relatively smaller diameter than the forward portion or the rear portion of the base 110. The medial portion 116 is thus inside of the ring formed by the forward and rear portions.

FIG. 4A a view looking down from the top of the bushing of FIG. 4, looking from the line IVA—IVA in the direction of the arrows. As shown here, the bushing 100 is ring-like with inwardly extending tines 130 carried by the fingers 120. The base portion 110 is visible only between the individual 120, and of course extends around the entire ring-like portion underneath the fingers 120. The seam 140 is shown.

The bushing 100 in the present invention is preferably made from a soft metal such as beryllium copper (preferably a CA-172 alloy sold as Berylco 25 alloy by Kawecki Berylco Industries). After forming, the bushing is heat-treated in a known manner to harden the metal and to impart spring characteristics. The use of beryllium copper is advantageous in that it has good physical strength when heat-treated; it is non-magnetic as required for MIL-SPEC applications; and it is easily workable in its soft (pretreated) state.

FIGS. 5–8 are views of the contact retention bushing 100 in its preferred application of retaining an electrical contact within the passage of an electrical connector assembly.

Figure 5:
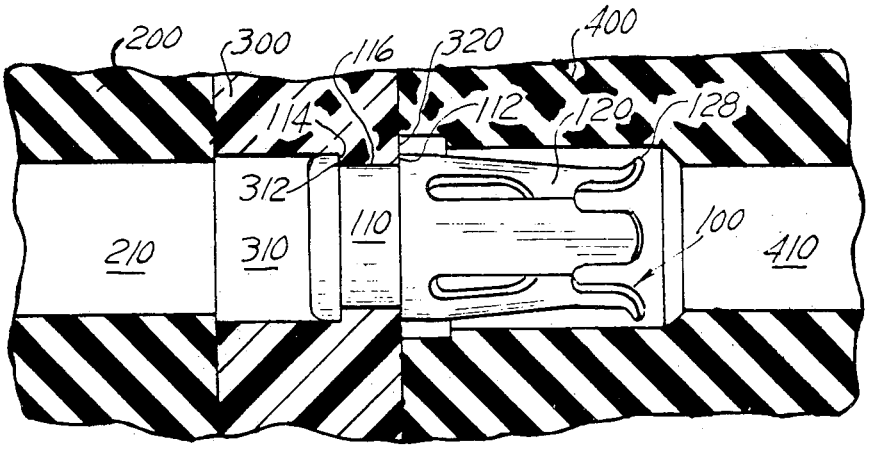
FIG. 5 is a partial cross-sectional view of an assembly for receiving a contact retention bushing, showing the full bushing.

FIG. 5 shows the configuration of a typical example of an electrical connector assembly. The connector assembly includes a grommet 200, a wafer 300 and an insert 400. Each of the three members includes a passage, with the grommet 200 having a passage 210, the wafer 300 having a passage 310 and the insert 400 having a passage 410. The passages 210, 310, 410 are axially aligned to receive a contact extending through the aligned passages.

The grommet 200 is preferably made of rubber and includes webs (not shown) to provide a moisture barrier for the electrical contact.

The wafer 300 is preferably made of nylon or other suitable hard plastics and includes a forward shoulder 312 around its passage 310 upon which the retention bushing 100 is mounted.

The insert 400 is also made from a dielectric (rubber) material and is of a conventional design, which is not relevant to the present invention.

The bushing 100 is mounted within the aligned passages 310, 410. The medial portion 116 of the base 110 is mounted on the shoulder 312 of the wafer 300. The forward shoulder 112 of the base 110 of the bushing 100 is carried on a forward edge 320 of the wafer 300 and the rear shoulder 114 is carried on the rear of the shoulder 312 of the insert. Thus, the bushing 100 is captivated within the passage 310 by the cooperation of the shoulders 112, 114 with the shoulder 312 of the wafer and the forward edge 320.

The contact retention bushing 100 shown in FIGS. 5–8 is slightly different than the retention bushing of FIG. 4 in that the forward end of the fingers 120 have outwardly flaring projections to receive a contact or releasing tool in the forward portion thereof. This slight modification of the bushing is preferred in some embodiments, and may be simply accomplished by a forming operation performed between the FIG. 3 and the FIG. 4 views.

Figure 6:
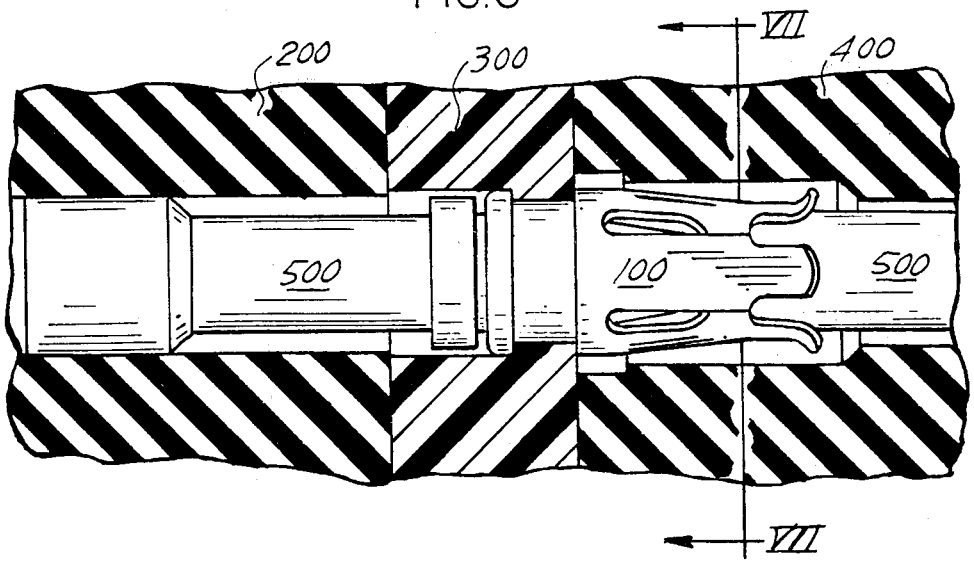
FIG. 6 is a view of the bushing of FIG. 5 and the mounting showing the insertion of an electrical contact within the bushing.

FIG. 6 shows the contact retention bushing 100 of FIG. 5 with the addition of an electrical contact 500 being mounted therein. As shown in FIG. 6, the contact 500 extends completely through the bushing 100 and is captivated therein. The contact may be either of the pin or socket type and may be made in any one of the number of conventional manners. A manufacturing method for making one type of such a pin or socket disclosed in U.S. Pat. No. 4,072,394.

FIG. 7 is a cross-sectional view of the contact 500 and bushing 100 mounting of FIG. 6, looking along the line VII—VII of FIG. 6 in the direction of the arrows.

Except in the region of the bushing seam 140, the contact 500 is surrounded by the bushing 100, which includes the base portion 110 and the fingers 120, with each finger having a pair of retention tines 130. Surrounding the bushing and contact is the insert 400, with the wafer 300 in which the bushing 100 is mounted behind the bushing 100 and the insert 400.

FIG. 8 shows the mounting of the contact within the bushing, showing the tine 130 retaining the contact 500 by engaging a rearwardly facing shoulder 510 of the contact 500. Advantageously, each of the contact retention tines 130 carried on the fingers 120 has a forward edge 131 which is aligned with the contact shoulder 510 and engages the shoulder 510 along a significant length of the shoulder to provide a low stress, low wear retention system. Thus, if the shoulder 510 extends radially outward, the best configuration for the forward tine edge 131 is to also extend in a radial direction when mounted.

FIG. 9 is a partial, enlarged view of the retention tine and contact shoulder of FIG. 8. The forward edge 131 of the tine 130 is aligned with the surface of the contact shoulder 510 to provide a good engagement between the tines 130 and the shoulder 510.

For removing the contact, a suitable tool is inserted from the forward end to spread the fingers 120 radially outward at least by the distance the tines 130 engages the shoulder 510. Such tools are well known in the art.

Further objects and inventions of the present invention will be apparent to those skilled in the art in view of the foregoing description and the drawings. Further, some features of the present invention may be used to advantage without the use of other features. The modification of the present invention to include more or fewer lobes, depending on the size of the passage and the contacts, may be advantageous. Further, the steps in the forming process may be advantageously performed in a different sequence, or using fewer or more stamping or forming steps. Instead of the stamping process, the chemical milling of metal stock might be useful in some limited production operations to provide the bushing shape of FIG. 1. Thus, portions of the present invention might be used without others without departing from the spirit of the present invention. Accordingly, the foregoing description should be considered as an illustrative only of the present invention and should not be interpreted to limit the scope of the present invention, which is defined by the following claims.

I claim:

1. A method of making a bushing for retaining an electrical contact within an electrical connector, the steps of the method comprising:

stamping from flat stock a predetermined shape having an elongated base portion and a plurality of elongated members extending forwardly from the base, each of said members having laterally-extending projections located intermediate their length;

forming the base portion into a three-dimensional shape having two laterally extending shoulders;

forming the projections out of the plane of the members by bending the projections to a position extending transversely to the members to form retention tines adapted to engage a contact; and forming the entire retention bushing into a ring-like shape with the tines extending inwardly, the ends of the base portion meeting at a seam and the forwardly extending members each being shaped into an arcuate cross-section disposed about the ring portion to provide symmetry about the central axis of the ring, whereby a stamped and formed retention bushing having inwardly extending tines for releasably retaining a contact is made.

2. A method of making a contact retention bushing of the type described in claim 1 where the bushing is initially stamped from a soft metal and, after at least some of the forming steps, is heat-treated to harden the metal.

3. A method of making a contact retention bushing of the type described in claim 1 where the tines are formed substantially perpendicular to the elongated members to extend substantially radially inwardly when formed.

4. A method of making a retention bushing in claim 1 wherein the steps of the method further include forming the free forward ends of the elongated members into an outwardly flaring shape for receiving and guiding a tool into the bushing to release the contact from the tines of the bushing held therein.

5. A method of making a stamped retention bushing of the type described in claim 1 wherein the step of stamping flat stock into a base portion and a plurality of elongated members includes forming four elongated members with approximately uniform spacing between each of the members whereby a symmetrical bushing may be formed.

* * * * *